US005092247A

United States Patent [19]

Aubermann

[11] Patent Number: 5,092,247

[45] Date of Patent: Mar. 3, 1992

[54] PROCESS FOR CONVERTING A RAILWAY-TRACK RENEWAL TRAIN AND VEHICLE FOR CARRYING OUT THE PROCESS

[75] Inventor: Tibor Aubermann, Saint-Legier, Switzerland

[73] Assignee: Matisa Materiel Industriel S.A., Crissier, Switzerland

[21] Appl. No.: 582,504

[22] Filed: Sep. 13, 1990

[30] Foreign Application Priority Data

Sep. 26, 1989 [CH] Switzerland ..... 3488/89

[51] Int. Cl.[5] ..... E01B 27/08

[52] U.S. Cl. ..... 104/2; 105/215.2; 105/159; 104/5

[58] Field of Search ..... 104/2, 5; 105/72.2, 105/215.1, 215.2, 159

[56] References Cited

U.S. PATENT DOCUMENTS 3,035,529 5/1962 Stewart ..... 105/215.2 X 3,926,128 12/1975 Zappel ..... 105/215.2 X 4,542,697 9/1985 Cicin-Sain ..... 104/2

*Primary Examiner*—Robert J. Oberleitner

*Assistant Examiner*—Kevin D. Rutherford

*Attorney, Agent, or Firm*—Darby & Darby

[57] ABSTRACT

A method and apparatus for converting a railway-track renewal train into a train for laying new railway track. The railway-track renewal train includes a first truck bearing on a bogie rolling on a renewed track, a second truck bearing on spaced first and second bogies of which the first bogie rolls on an old track and the second bogie moves on old ties or sleepers, and various means for removing the old rails and sleepers and for laying new rails and sleepers. The bogie of the first truck is mounted onto a vehicle designed to remain on site and having a motor for moving the vehicle on the ballast or platform. The vehicle is moved in the direction of movement of the renewal train or in the opposite direction dependent on whether an old railway track is removed or new track is laid.

6 Claims, 4 Drawing Sheets

PROCESS FOR CONVERTING A RAILWAY-TRACK RENEWAL TRAIN AND VEHICLE FOR CARRYING OUT THE PROCESS

FIELD OF THE INVENTION

The present invention relates to a process for converting a railway-track renewal train, comprising essentially a first truck bearing on a bogie rolling on the renewed track, a second truck, of which at least one bogie rolls on the old track and another moves on or above the platform (e.g., the ballast) or old sleepers (i.e., the railroad tier) devoid of rails, wagons for storing the equipment used, and various means for removing the old rails and sleepers, for laying new rails and sleepers and for transporting the old and new sleepers, and driving means, into a train for laying a new railway track, by neutralizing or dismounting the means for removing the old rails and sleepers and the means for transporting the old sleepers, by adapting or replacing the means for laying the new railway track, in such a way that they are capable of working when the train moves in the opposite direction to that of the renewal train. The invention also relates to a process for converting a renewal train into a train for removing a redundant railway track, and to a vehicle making it possible to carry out the processes according to the invention.

PRIOR ART

Such a renewal train is described in FR-A-2,419,998 and can be converted into a train for laying a new track. The motor wagon already rolls on the new track, whilst the bogie of the wagon for handling the sleepers and for laying the rails located in the working zone is mounted on a translational device which moves by sliding or rolling in the countersinks of the old sleepers devoid of rails. The second bogie of the same wagon rolls on the old track, as do the various storage wagons. To convert this train into a train for laying a new track, the running direction is reversed and the single bogie of the motor wagon is equipped with tires allowing it to advance on the platform of the track.

The disadvantage of this train is that, when the bogie equipped with tires moves on the platform, which may or may not be provided with a layer of ballast, and because the tires with which the bogie can be equipped are of a relatively small width, the pressure exerted on the platform is so high, the more so as this is a traction bogie, that the platform, which may or may not have ballast, experiences deformation, thereby compromising the accuracy and quality of the work of laying the new track. Thus, in some cases, before the track is laid there has to be additional work to restore the platform in order to prevent the deformation of the new track.

It has been proposed to equip the motor wagon with additional retractable means making it possible to bear on the platform by means of devices limiting the pressure exerted on the platform, such as crawlers, in which case the bogie of the motor wagon is not in contact with the platform. This solution, although making it possible to overcome the disadvantages of tires, has two other disadvantages, namely:

1. The motor wagon has to be equipped with an additional device which, on the one hand, needlessly burdens the wagon when the train is in track-renewal formation and, on the other hand, needlessly increases the overall cost of the train;

2. The geometry of the train and therefore of the measuring bases necessary for laying the new track are modified, since the contact point of the motor wagon with the platform is shifted to the height of the crawlers.

SUMMARY OF THE INVENTION

The object of the present invention is to provide a process and a device for carrying out the process, making it possible, on the one hand, to benefit from the advantages of the two solutions mentioned above and, on the other hand, to eliminate their disadvantages.

The process according to the invention is characterized in that the bogie of the first truck is mounted onto a vehicle which is intended for remaining on site and which is equipped with motor means and with means allowing it to move on the platform.

The advantages of the process according to the invention in relation to the abovementioned examples are:

The reduction of the pressure exerted on the platform, the vehicle preferably being equipped with crawlers making it possible to distribute the weight of the wagon, which amounts to several tons, over much larger bearing surfaces than those of the tires.

Neither the geometry of the train nor that of the measuring bases is modified.

The train, more particularly the wagon, moving on the platform during the laying of the new track does not have to support the additional weight of a retractable crawler device, and likewise no additional cost during the construction of the wagon need be envisaged for the modification of its chassis, since the same step bearing is used for transmitting the forces.

The railway-track laying train must from time to time, usually in the evening, return to a station or to a stock of equipment used for laying the track (sleepers, rails, ballast, etc.), this being very easy because it is sufficient to allow the bogie to descend onto the new railway track and move the train by light running in the opposite direction to that of the track laying, leaving the traction vehicle where it is, and this work can be carried out very quickly and without any complication. Next day or after the train is stocked with the requisite equipment, it returns to the end of the line by moving in the opposite direction (the same direction as during the laying of the new track), the bogie is mounted on the traction vehicle which has remained at or been brought to the end of the line, and the work can begin again.

In economic terms, this process also has the advantage of providing an economical solution, since the vehicle making it possible to convert the train into a train for laying or removing a railway track is independent of the renewal train (the basic configuration), thus allowing a private company or the state to purchase several railway-track renewal trains, since this is the work most often carried out, and incidentally to have a traction vehicle which can be used with any renewal train when the latter has to carry out the laying of a new track, without having to bear the expense of purchasing several renewal trains also equipped for laying a railway track, which is work less common than that of renewal.

According to an alternative version of the process according to the invention, the vehicle is driven by means of hydraulic motors fed by the same supply source as the drive motor of the bogie when the latter is on the rails, thus making it possible to save a powerful energy source on the vehicle to obtain the driving of the train.

Incidentally, the invention also makes it possible to convert the renewal train into a train for removing a redundant railway track. In this case, the vehicle is no longer a traction vehicle, but a pushing vehicle, since the track-removal train moves in the same direction as the renewal train.

This process for converting a renewal train makes it possible, as required, to convert a basic machine into three different machines at little cost, namely:

1. a railway-track renewal train (the basic configuration);
2. a renewal train converted into a train for laying new tracks, with a change of the direction of movement of the renewal train or an adaptation of some of the tools and a neutralization of others;
3. the conversion of the renewal train into a railway-track removal train, with the neutralization of some of the tools equipping the renewal train.

The invention also relates to a vehicle making it possible to carry out the process according to the invention, characterized in that it comprises at least two chassis equipped with means for rolling on the platform in the absence of the railway track and joined together by means of a rigid structure or making it possible to absorb the inequalities of the platform, supports allowing the bogie to roll, and means making it possible to block the said bogie on the said supports and motor means for driving the vehicle.

As mentioned above, the vehicle is preferably equipped with crawlers and, in general, with two pairs of crawlers, the crawlers of a pair being spaced to leave room for supports on which the bogies roll and which are preferably two rail sections. Means are provided for blocking the bogies when they are located on the traction vehicle, these means preferably consisting, on the one hand, of two buffers located at the end of the rails and stopping the front bogies (in the direction of movement of the bogies during the loading onto the vehicle) and of two retractable levers, one for each front wheel of the bogie, which come to bear at one of their ends on a rear part of the said wheels, to prevent the bogie and therefore the truck from retreating by rolling or sliding on the supports.

Preferably, the vehicle is equipped with hydraulic motors designed to be fed by the supply source of the bogie.

According to a preferred version, the vehicle can also be equipped with an independent energy source allowing it to move independently in order to come to the end of the railway track and even to carry out small jobs involving handling or movement on the platform, of course when the bogie is not loaded on the vehicle.

The vehicle is also equipped with a removable device allowing the loading and unloading of the bogie. It preferably consists of a ramp which is formed from two rails and has a slope and which takes position on the end of the track already laid, in order to make it possible to bring the bogie level with the supports provided on the vehicle, and a plate forming a bridge between, on the one hand, the ramp and, on the other hand, the vehicle, on which the said plate, likewise equipped with rails, is articulated. This auxiliary device can either be removable or form part of the vehicle.

In some countries, the ballast is unloaded on to the platform before the laying of the new track. In this case, the vehicle can advantageously be equipped with a vertically adjustable plough in order to make it possible to level the ballast at least approximately.

BRIEF DESCRIPTION OF THE DRAWINGS

The invention will now be described in more detail by means of the accompanying drawing.

DESCRIPTION OF THE PREFERRED EMBODIMENT

Figure 1:
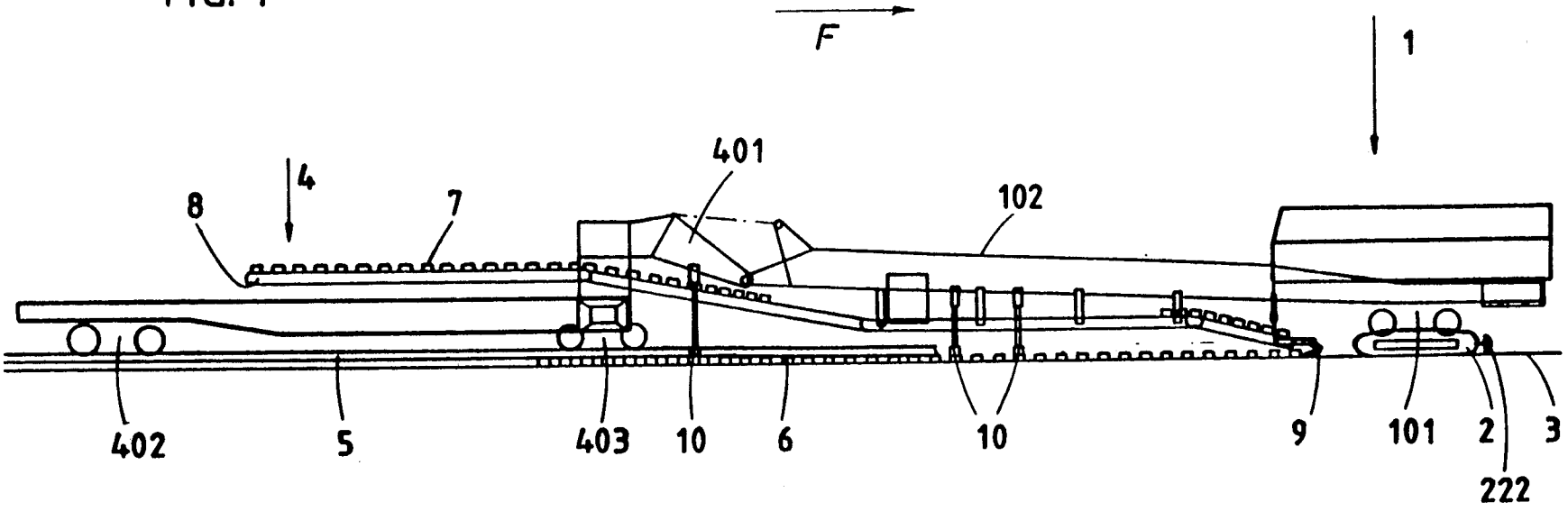
FIG. 1 shows a partial diagrammatic side view of a renewal train converted into a train for laying a new railway track, according to the invention.

FIG. 1 shows a diagrammatic representation in the form of a side view of the first two vehicles of a renewal train converted into a railway-track laying train, according to the invention. It is composed of a first truck 1 resting by means of its bogie 101 on a traction vehicle 2 equipped with means for being moved directly onto the platform 3 on which the new track is to be laid. The truck 1 has a beam 102 articulated on the second truck 4, especially on a bracket 401. The truck 4 rests by means of two bogies 402 and 403 on the rails 5 of the newly laid railway track. It is possible that, if the beam 102 is not long enough, the bogie 403 will not be able already to roll on the rails 5 laid on the sleepers 6, and a sliding device, such as that described in FR-A-2,419,998, or a similar device, must be used. Other wagons supporting the equipment of the new railway track follow the truck 4, but are not shown here. The beam 102 and second truck 4 support various tools and devices known per se for transporting and installing new sleepers 7 and for installing rails 5 on the sleepers. No further details will be given of these known tools and devices which are shown diagrammatically here, namely a conveyor band 8, a device 9 for the distribution of sleepers 7 and grippers lo for installing rails 5 in the countersinks of the laid sleepers 6. This list of devices and tools is not exhaustive and can be supplemented by a sleeper screwdriver device, etc.

The movement of the renewal train mounted on the vehicle 2 takes place in the direction of the arrow F, when modified and used for laying track in accordance with our invention, as further described below, which is the opposite direction to the movement of the renewal train.

The process which is the subject of the present invention therefore involves, starting with a renewal train, such as that described in FR-A-2,419,998 or the like, converting it into a train for laying new tracks, by neutralizing the tools for removing the old track and by modifying the tools for laying the new track so that they can work in the opposite direction. Preferably, the tools for laying the new track are also removed in order to replace them with tools for laying the new track which work over a greater length, since they can extend over the entire length of the beam 102. This arrangement makes it possible to work quickly in order to lay the new track, because the work is carried out over a greater length, thereby also in some cases allowing the bogie 403 of the second truck already to roll on the rails 5 of the new track laid on the sleepers 6. Another advantage is that, during the laying of the rails, the forces to which the rails are subjected during lifting and installation and which are attributable to the elastic deformations of the rails are less great if the work of installing the rails is carried out over a greater length.

The truck 1 is thereafter mounted on the traction vehicle 2 which is brought to the end of the laid or existing line, the bogie 101 of the truck 1 in that case rolling on the rails. The bogie 101 and therefore the truck 1 are mounted onto the vehicle 2 which from that moment will ensure the traction of the train as a whole, as will be seen later. The vehicle is equipped with a vertically adjustable plough 222 which, where appropriate, will ensure the levelling of the rolling surface, especially of the ballast which has previously been unloaded.

The vehicle 2 is equipped with hydraulic motors which are connected to the hydraulic energy source feeding the bogies 101 of the truck 1, thus avoiding the need to have a second powerful energy source for driving the traction vehicle 2 supporting the bogie 101.

A preferred embodiment of the vehicle 2 making it possible to carry out the process according to the invention will now be described with more specific reference to FIGS. 2 and 3.

The vehicle preferably comprises two pairs of crawler chassis 201, 202, 203, 204. The chassis of a pair are spaced laterally to allow installation of supports 205 which, in fact, are rails on which the bogie 101 rolls when it is loaded onto or unloaded from the vehicle 2. The crawler chassis of each pair are connected rigidly together, and each pair is connected to the other likewise rigidly or, in some cases, by means making it possible to absorb the irregularities of the platform.

Figure 2:
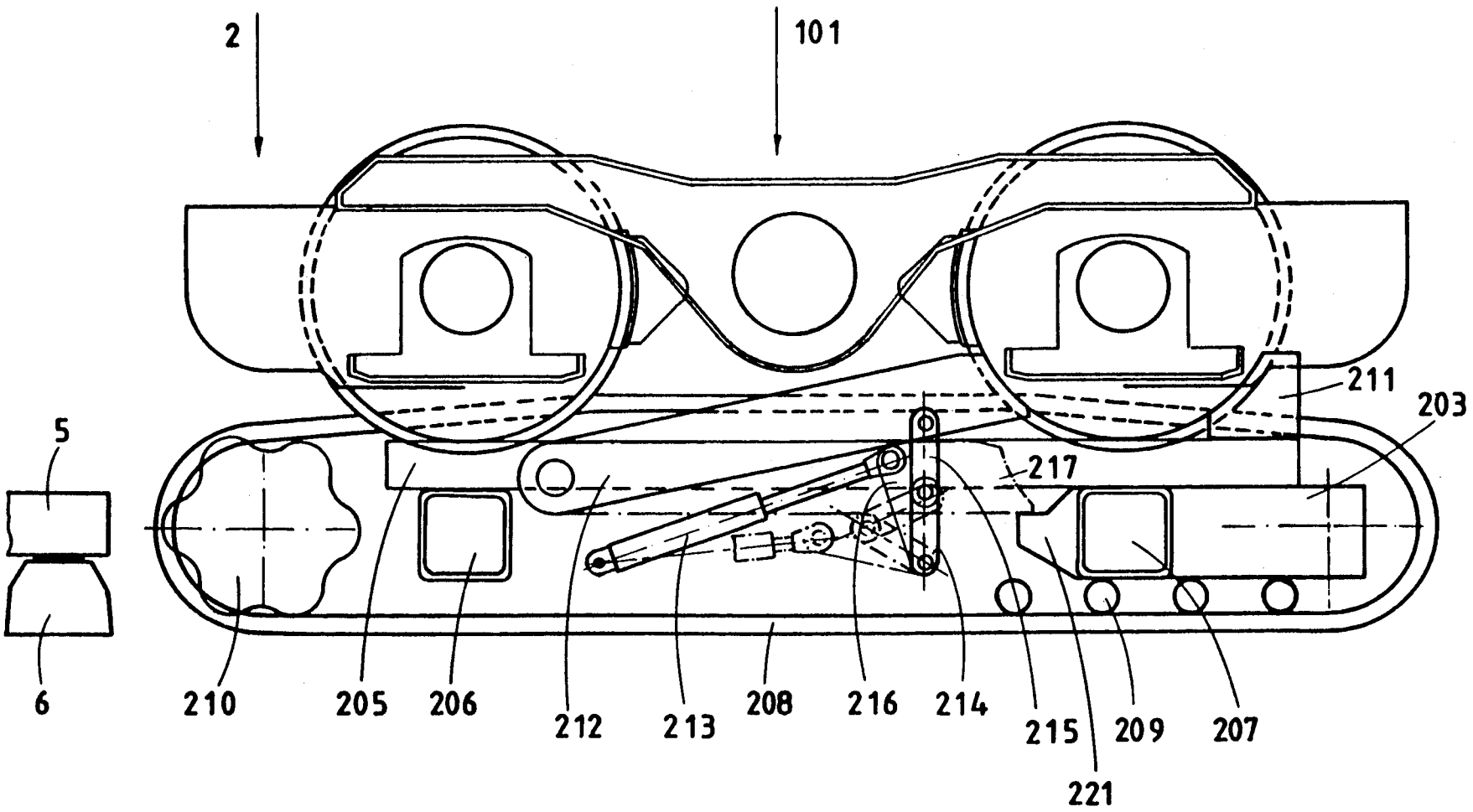
FIG. 2 is a diagrammatic side view of a vehicle according to the invention supporting a bogie, the outer crawler being omitted.
Figure 3:
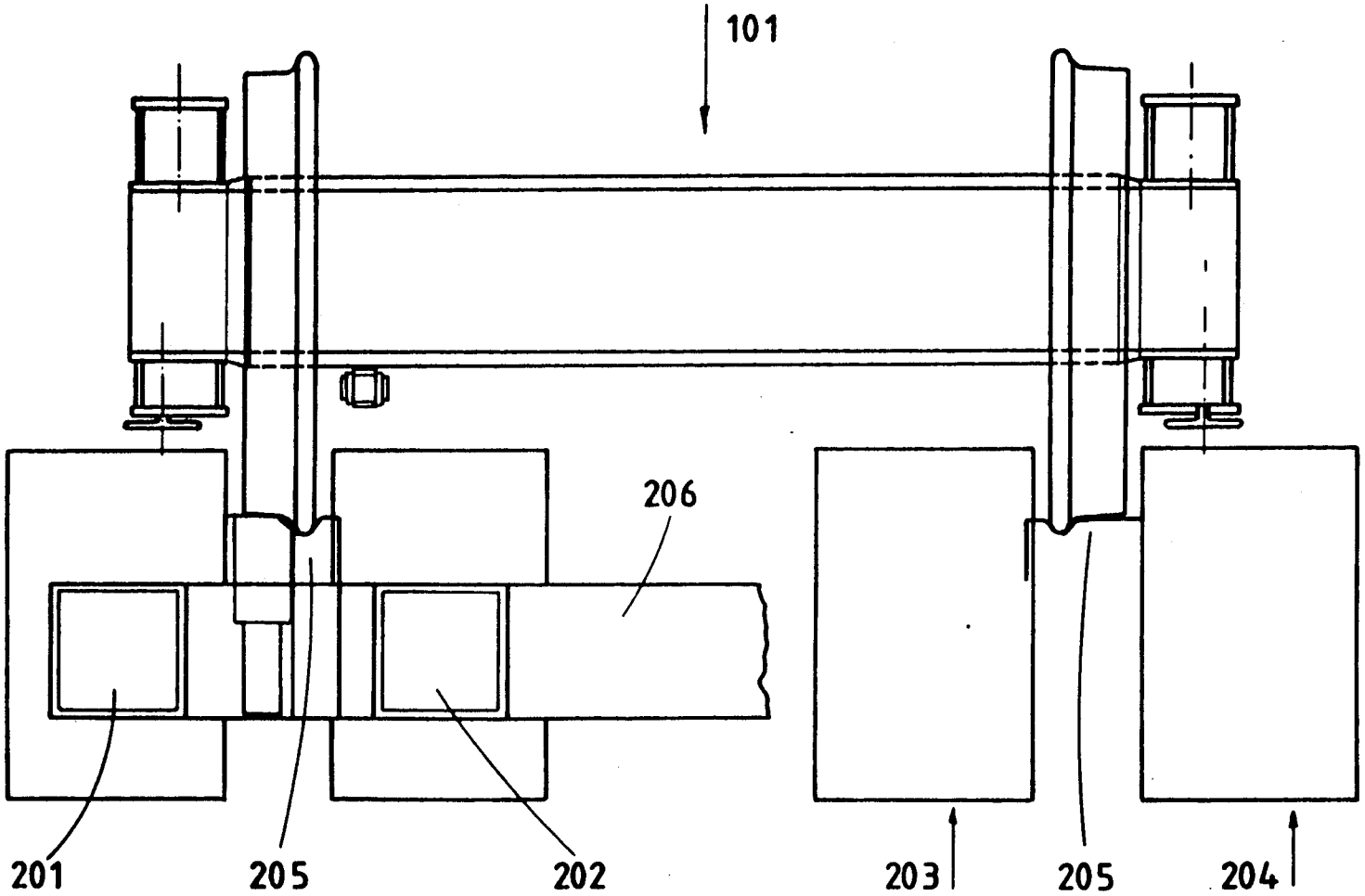
FIG. 3 is a diagrammatic partially sectional front view of a vehicle supporting a bogie.

In the example illustrated in FIGS. 2 and 3, the crawler chassis 201 to 204 are connected by means of two rectangular beams 206, 207. FIG. 2, which is a side view of the vehicle 2 without the chassis 204, shows diagrammatically the crawler chassis 203 comprising a chain or tread 208, rollers 209, two gearwheels 210 ensuring the drive (the front wheel of the vehicle, in the direction of movement during the laying of the new track, is not shown in order to avoid overloading the drawing), the rails 205 on which the bogie rests and which bear on the sleepers rectangular beams 206, 207 connecting the four crawler chassis, and a device making it possible to block the bogie 101 when it is located on the vehicle 2. The device making it possible to block the bogie 101 and therefore the truck 1 on the vehicle comprises a buffer or block 211 for each rail 205, located at the front end of the rail 205. A retractable lever 212, represented here in the bogie-blocking position by unbroken lines and in the retracted position by dot-and-dash lines, prevents the bogie from sliding or rolling rearwards. The lever 212 is articulated at one of its ends on the chassis of the vehicle 2, and it is controlled by a hydraulic jack 213 acting on two links 214, 215. The link 214 is articulated at one end on the chassis of the vehicle 2 and at the other on the second link 215, the second end of which is articulated on the blocking lever 212. The jack 213 is fixed to the link 214 by means of a triangular extension 216 of the latter. The end of the lever 212 has a profile matching the rolling surface of a bogie wheel, against which it butts so as to prevent it from moving. In the retracted position, the end of the lever 212 rests on a stay 221 fixed to the beam 207. For reasons of safety, a blocking device is provided for each pair of crawlers.

Of course, the lever 212 can be controlled by other mechanical means or even manually. Other means for blocking the bogie 101 can likewise be used.

The vehicle is equipped with drive means which are basically hydraulic motors fed directly by the hydraulic energy source conventionally driving the bogie 101 of the truck 1. These means have not been shown here so as to simplify the drawing.

According to one version, these drive means can be fed by an independent energy source allowing the vehicle 2 to move on the platform in the absence of the bogie 101, in order also to carry out particular handling jobs and make it easier to load the vehicle onto a transporter wagon.

Although the foregoing description described a vehicle comprising two pairs of crawler chassis, it is clear that the invention is not limited to this embodiment, and it would be perfectly possible to have a vehicle bearing on two crawler chassis arranged on either side of the vehicle.

It goes without saying that the vehicle 2 is designed to be capable of supporting the bogie of the truck 1 suitable for the proper gauge of the track to be laid or removed.

A device for varying the oil flow between the crawlers makes it possible to steer the vehicle 2.

Figure 4:
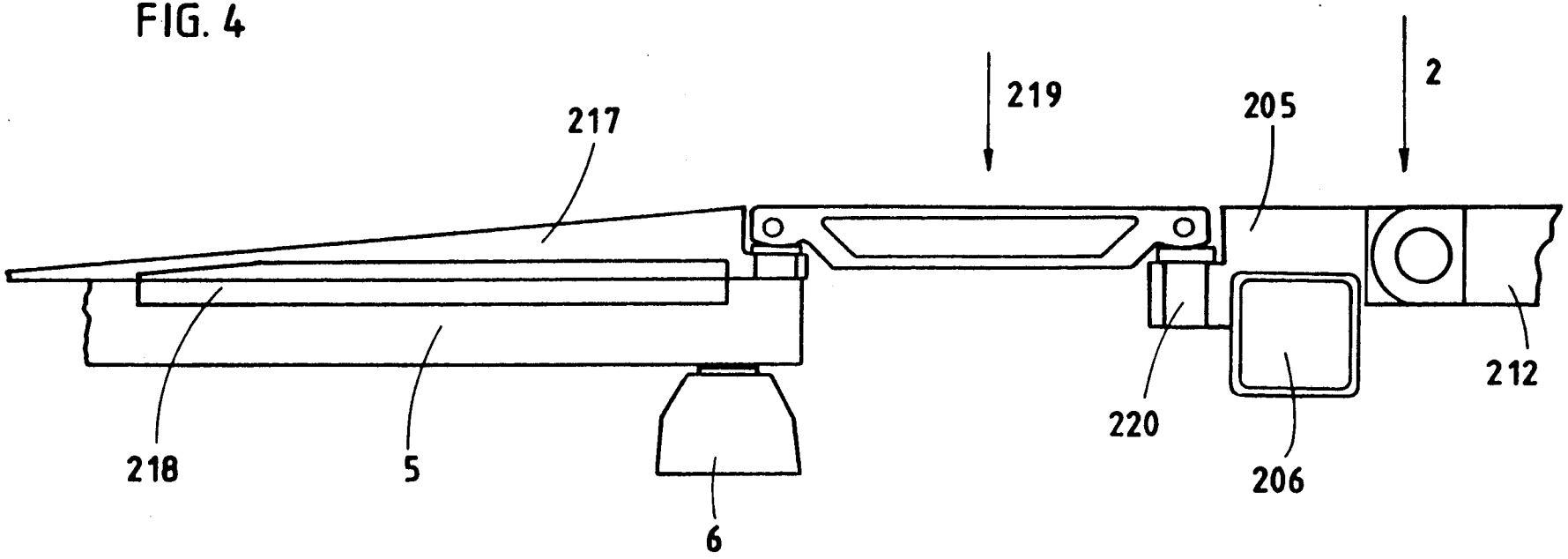
FIG. 4 is a diagrammatic side view of the device making it possible to load the bogie onto and unload it from the traction vehicle.

FIG. 4 illustrates a device allowing the bogies 101 of the truck 1 to mount onto the vehicle 2 and descend from the vehicle 2 at the end of the work. It consists of a ramp actually composed of two rails 217 having a slope and taking position on the end of the track already laid, particularly on the rails 5. The positioning and centering are obtained by means of two blades 218 arranged on either side of the rails 217 having the slope. The end of the ramp is articulated on a plate 219 forming a bridge between the ramp and the vehicle 2, on which the plate 219 is articulated by means of a fixed or removable pivot 220. It goes without saying that the plate 219 also possesses a runway for the bogie. The device 217 to 220 can either be removable or be folded up and moved at the same time as the vehicle 2.

The same vehicle is used for converting a renewal train into a train for removing a railway track, the only difference being that, in this case, the movement of the train takes place in the opposite direction to the arrow F of FIG. 1, that is to say in the same direction as the movement of the renewal train. In this case, the vehicle 2 moves on the stripped platform. The only necessary conversion of the renewal train is the neutralization of devices and tools for laying the new track.

The vehicle 2 can be guided by known means, namely manually, optical system, laser, etc.

I claim:

1. A vehicle for converting a railway-track renewal train into a train for laying or removing railway track, the railway-track renewal train including a first truck bearing on a bogie capable of rolling on a track and a second truck bearing on spaced first and second bogies, said vehicle comprising:

supports on which the bogie of the first truck of the railway-track renewal train can roll;

at least two chassis for supporting said supports and having means for rolling on the platform in the absence of a railway track;

a rigid structure for joining the at least two chassis;

means for blocking the bogie of the first truck on said supports; and motor means for driving the vehicle;

said blocking means including a buffer fixed at an end of each of said supports for engaging a front part of a respective front wheel of the bogie of the first truck, and a lever associated with said buffer and spaced therefrom and actuatable to a position in which an end of said lever engages a rear part of the respective front wheel to prevent the bogie of the first truck from rolling on said supports.

2. A vehicle as set forth in claim 1 further comprising an independent supply source for feeding said motor means.

3. A vehicle for converting a railway-track renewal train into a train for laying or removing railway track, the railway-track renewal train including a first truck bearing on a bogie capable of rolling on a track and a second truck bearing on spaced first and second bogies, said vehicle comprising:

supports on which the bogie of the first truck of the railway-track renewal train can roll;

at least two chassis for supporting said supports and having means for rolling on the platform in the absence of a railway track;

a rigid structure for joining the at least two chassis;

means for blocking the bogie of the first truck on said supports; and motor means for driving said vehicle, said motor means comprising hydraulic motors fed from an energy supply source of the bogie of the first truck.

4. A vehicle for converting a railway-track renewal train into a train for laying or removing a railway track, the railway-track renewal train including a first truck bearing on a bogie capable of rolling on a track and a second truck bearing on spaced first and second bogies, said vehicle comprising:

support rails for supporting the bogie of the first truck of the railway-track renewal train;

a pair of crawler chassis for supporting said support rails and having means for rolling on the platform in the absence of a railway track;

a rigid structure for joining the two pairs of crawler chassis and capable of absorbing inequalities of the platform;

means for blocking the bogie of the first truck on said supports;

motor means for driving said vehicle; and means for loading and unloading the bogie of the first truck onto and from the vehicle, said loading and unloading means comprising a sloping ramp to be positioned at an end of the railway track, a horizontal plate forming a bridge between an elevated end of said ramp and said support rails, first pivot means for pivotally attaching said elevated end of said ramp at one end of said plate, and second pivot means for pivotally attaching an opposite end of said plate to ends of said support rails.

5. A vehicle as set forth in claim 4 further comprising a vertically adjustable plough attached at a front end of said vehicle for equalizing the surface of the platform on which the vehicle moves during laying of the new track.

6. A method of converting a railway-track renewal train into a train for laying or removing railway track, the railway-track renewal train including a first truck bearing on a bogie rolling on a renewed track, a second truck bearing on spaced first and second bogies of which the first bogie rolls on the old track and the second bogie moves on one of a platform and old sleepers devoid of rails or moves above the platform, track renewal working means including means for removing the old sleepers, equalizing the platform, laying new sleepers, for removing and guiding old rails, for guiding and laying new rails, and for transporting the old and new sleepers, and driving means, said method comprising the steps of:

rendering ineffective said track renewal working means;

providing a vehicle designed to remain on site and having motor means for moving the vehicle on the platform;

mounting the bogie of the first truck onto the vehicle; and moving the vehicle in the opposite direction to the movement of the renewal train to lay new track or in the same direction to remove old track.

* * * * *